US005179826A

United States Patent [19]

Yasuda et al.

[11] Patent Number: 5,179,826

[45] Date of Patent: Jan. 19, 1993

[54] UNIT DRIVING MECHANISM OF SPINDLES IN A SPINNING FRAME

[75] Inventors: Hironori Yasuda; Katumoto Yamamoto, both of Inazawa; Osamu Yoshida, Gifu, all of Japan

[73] Assignee: Howa Machinery, Ltd., Aichi, Japan

[21] Appl. No.: 575,362

[22] Filed: Aug. 30, 1990

[30] Foreign Application Priority Data

Sep. 5, 1989 [JP] Japan ..... 1-229870

[51] Int. Cl.[5] ..... D01H 13/00

[52] U.S. Cl. ..... 57/104

[58] Field of Search ..... 57/104, 105, 88

[56] References Cited

U.S. PATENT DOCUMENTS

| | | | |
|---|---|---|---|
| 2,655,782 | 10/1953 | Cutler | 57/105 |
| 3,035,400 | 5/1962 | Stahlecker | 57/105 |
| 3,548,582 | 11/1968 | Staufert | 57/88 |
| 3,753,344 | 8/1973 | Merck | 57/105 |
| 4,781,015 | 11/1988 | Dinkelmann et al. | 57/105 |

FOREIGN PATENT DOCUMENTS

| | | | |
|---|---|---|---|
| 1287948 | 4/1961 | France | 57/104 |
| 63-243336 | 10/1988 | Japan . | |
| 266065 | 4/1950 | Spain . | |
| 329194 | 5/1930 | United Kingdom | 57/105 |

*Primary Examiner*—Daniel P. Stodola
*Assistant Examiner*—John Rollins
*Attorney, Agent, or Firm*—Stevens, Davis, Miller & Mosher

[57] ABSTRACT

In the driving mechanism for driving spindles of a ring spinning frame, wherein spindle alignments of the R side and the L side thereof are divided into a plurality of sub-unit groups of spindles respectively so that a plurality of unit groups of spindles are formed along the lengthwise direction thereof by pairs of sub unit groups of spindles, each pair of sub-unit groups of spindles consist of a sub-unit group of spindles of R side, and a sub-unit group of spindles of L side which faces the sub-unit group of spindles of R side, a plurality of unit driving mechanisms are formed along the lengthwise direction thereof to drive the corresponding one of the above-mentioned plurality of the unit groups of spindles respectively, spindles of each unit driving mechanism are driven by a single spindle tape, and the spindle tape is driven by a driving motor, and such improvement is applied so that the spindle tape is driven by the driving motor by way of at least two driving wheels, and the number of spindles per one driving wheel is less than six.

4 Claims, 4 Drawing Sheets

UNIT DRIVING MECHANISM OF SPINDLES IN A SPINNING FRAME

BACKGROUND OF THE INVENTION

1. Field of the Invention

The present invention relates to a mechanism for driving spindles in a ring spinning frame. More particularly, it relates to an improved unit driving mechanism applied to drive spindles of in a ring spinning frame.

2. Description of the Related Arts

In the driving of spindles of a ring spinning frame, the ring spinning frame must be driven in such a way that the consumption of electric power thereby is lowered, to reduce operating costs. A problem arises, however, of how to reduce variations in the rotation speed of the spindles, because such variations of the rotation speed of the spindles creates variations of the yarn quality at different spindles. Accordingly, it is essential to reduce the variations of the rotation speed of the spindles, to produce yarns having a good quality. This problem is particularly important when producing yarns by a large ring spinning frame provided with 900 spindles, or by a high speed ring spinning frame at which the rotation speed of the spindles is higher than 20,000 rpm. This is because, in the former case, the number of spindles is larger than that of the conventional ring spinning frame, and in the latter case, the yarn length produced in a unit time/spindle is larger than that of the conventional ring spinning frame.

To solve the problem of an increase of the electric power consumption, which raises the production costs, an improved driving mechanism applied to a ring spinning frame which is provided with a known tin pulley driving mechanism or a known tangential driving mechanism has been disclosed. For example, as shown in the invention disclosed by Japanese Unexamined Patent Publication No. Showa 63(1988)-243336, all of the spindles of a ring spinning frame are divided into a plurality of unit groups of spindles, wherein each unit group of spindles consists of two sub-groups of spindles aligned at both sides of a machine frame, respectively, in a condition such that the spindle alignments of the sub-groups at both sides of the machine frame face each other, and the spindles of each unit group are driven by a single drive mechanism. This single driving mechanism applied to unit groups of spindles partially solves the above-mentioned problem existing in a conventional driving system such as the tin pulley driving system. In the tangential driving system, however, it has been recognized that the problem of a reaction to the other spindles, due to the braking action applied to a spindle of a unit group of spindles by a knee brake, which is operated when a spinning yarn of the spindle concerned is broken, cannot be neglected when wishing to maintain the yarn quality. This problem is such that, when the braking action by a knee brake is applied to a spindle of a unit group of spindles driven by a single drive mechanism provided with an endless spindle tape, the spindle tape is elastically deformed by this braking action in the longitudinal direction thereof, and accordingly, the rotation speed of the other spindles of the unit group of spindles is varied. This variation of the rotation speed of the other spindles of the unit group of spindles has been confirmed by mill tests, and it has been recognized that such variations of the rotation speed of the spindles creates variations of the yarn twists, which is a serious problem when wishing to maintain the yarn quality in a good condition. Since a plurality of spindles of each unit group are driven by a single endless spindle tape, it is impossible to eliminate the above-mentioned variation of the rotation speed of spindles. Therefore, attempts have been made to maintain the variations of yarn twists in an allowable condition by keeping the above-mentioned variations of the rotation speed of spindles low. Generally, the allowance for the variations of yarn twists should not exceed 1%, and therefore, a desirable production policy is such that the variations of the rotation speed of spindles in each unit group of spindles when applying the knee brake to a spindle of the unit group of spindles should not be more than 1%.

As mentioned above, it is generally recognized by the normally skilled person in the spinning industry that the rotation speeds of the other spindles of a unit group spindles are varied when the knee brake is operated to brake the rotation of a particular spindle of an identical unit of spindles, but has not been clarified how the position of the other spindles in their respective relationships to the position of the above-mentioned particular spindle influences the reduction of the rotation speed of the other spindles.

On this point, if the above-mentioned phenomenon could be analyzed, it might be clarified that, regarding the rotation speed of the other spindles of the unit group of spindles, the rotation speeds of the other spindles are influenced by the braking action of the knee brake in such way that the reduction of the rotation speed of a spindle is larger when it is closer to the particular spindles to which the braking action of the knee brake is applied. Nevertheless, because of the relationship thereof to the arrangement of the driving pulleys and tension pulleys utilized in the above-mentioned driving system, it is practically impossible to theoretically analyze the above-mentioned phenomenon of a reduction of the rotation speed of the other spindles by the braking action applied to the above-mentioned particular spindle by means of the knee brake. Accordingly, to find a possible solution to the above-mentioned problem, an experiment has been applied to the above-mentioned unit driving system disclosed in Japanese Unexamined Patent Publication No. Showa 63(1988)-243336, to confirm the influence of the braking action applied to the particular spindle upon the rotation speed of the other spindles of the identical unit group of spindles. It was confirmed that the above-mentioned problem cannot be solved even by the application of a group driving system as mentioned above. Therefore, an object of the present invention is to provide an apparatus for driving spindles of a ring spinning frame wherein a driving system for a unit group of spindles is improved.

SUMMARY OF THE INVENTION

In the mechanism for driving spindles of a ring spinning frame, wherein the spindle alignments arranged along the right hand and left hand sides of the ring rails are divided into a plurality of sub groups respectively, and the plurality of unit groups of spindles are formed in such manner that each unit group of spindles is formed by a sub-group alignment on the right hand side and a sub-group alignment on the left hand side, which face each other, an improved unit driving mechanism of spindles is applied to each one of the above-mentioned unit group of spindles. In each unit driving mechanism, at least one driving wheel is arranged at an inside position close to the corresponding spindle alignment of the unit driving system, each one of the driving wheels is provided with a driving pulley which is rigidly and coaxially mounted on a common shaft thereof, a motor is coaxially and rigidly mounted on the shaft of one of the driving wheels, plural driving belts are mounted to each one of the driving pulleys of the R side of the spinning frame and a corresponding driving pulley or pulleys of the L side of the spinning frame, all spindles of each unit of spindles are driven by an endless spindle tape driven by the above-mentioned driving wheels, plural tension pulleys are arranged to maintain the effective tension of the spindle tape, and the number of spindles/single driving wheels is restricted in a range between four and six.

DESCRIPTION OF THE PREFERRED EMBODIMENTS

As described above, it has been recognized that, in the known system for driving a group of spindles, when the braking action by a knee brake is applied to a particular spindle of a unit group of spindle, the spindle tape utilized to drive the spindles of this unit group of spindles is elastically deformed in the longitudinal direction thereof, whereby the rotation speed of other spindles of the unit group is varied, and accordingly, the number of twists imparted to the spinning yarns of the other spindles is varied. It is practically impossible to theoretically analyze how the knee brake action applied to the particular spindle effects the rotation speed of the other spindles of the identical unit group of spindle. Accordingly, it is necessary to study the above-mentioned phenomenon by way of experiments.

Therefore, before explaining the embodiment of the present invention, the result of the experimental study applied to the known system of driving a unit group of spindles applied to the conventional ring spinning frame will be described with reference to FIG. 5.

Figure 5:
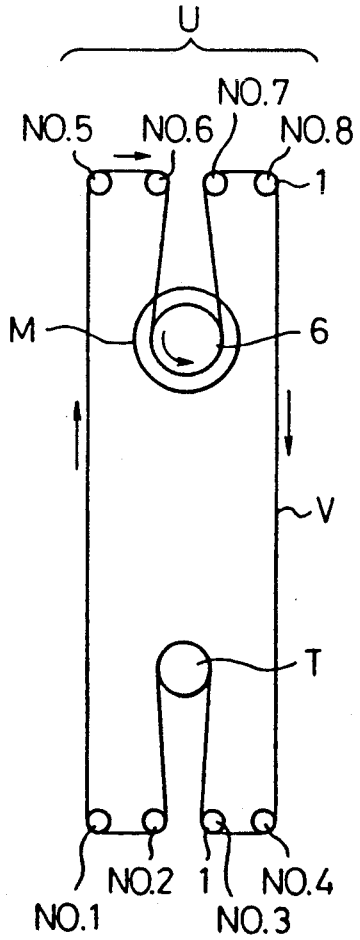
Fig. 5 PRIOR ART

In the known group driving system shown in FIG. 5, eight spindles 1 to 8 are driven by a single endless tape V, which drives these spindles by friction contact therewith. The spindle tape V is driven by a driving motor M by way of a driving wheel 6 rigidly and coaxially mounted on a shaft of the driving motor M. A tension pulley T is utilized to maintain the uniform contact of the spindle tape V to each spindle 1 of this unit group of spindles. In the experimental study, the following unit tests are applied to these spindles No. 1 . . . No. 8. Namely, in the first test applied to spindle number 1, the rotation speed of spindle No. 1 is continuously measured while the knee brake is stepwisely applied to one of the other spindles No. 2 to No. 8. This test confirms how the rotation speed of spindle No. 1 is changed by the braking action applied to each of the other spindles No. 2, No. 3, No. 4, No. 5, No. 6, No. 7 and No. 8, separately. The above-mentioned unit test is applied to each of the other spindles in the same manner as the above-mentioned unit test.

The result of the above-mentioned experiment is as follows.

Measuring the rotation speed of spindle No. 1

When the knee brake action was applied to spindle No. 5 and spindle No. 6, the rotation speed cf spindle No. 1 was reduced by 1.37% and 1.55%, respectively.

When the knee brake action was applied to other spindles, the rotation speed of spindle No. 1 was reduced within a range of between 0.87% and 0.37%.

Measuring the rotation speed of spindle No. 2

When the knee brake action was applied to spindles No. 1, No. 5, and No. 6, the rotation speed of spindle No. 2 was reduced by 1.40%, 1.25% and 1.51%, respectively, and in other cases, the rotation speed of the spindle No. 2 was reduced within a range of between 0.86% and 0.45%.

Measuring the rotation speed of spindle No. 3

When the knee brake action was applied to spindle No. 6, the rotation speed of spindle No. 3 was reduced by 1.15%, and in other cases, the rotation speed of spindle No. 3 was reduced within a range of between 0.85% and 0.39%.

Measuring the rotation speed of spindle No. 4

When the knee brake action was applied to spindle No. 6 and spindle No. 8, the rotation speed of spindle No. 4 was reduced by 1.08% and 1.05% respectively, and in other cases, the rotation speed of spindle No. 4 was reduced within a range of 0.77% to 0.26%.

Measuring the rotation speed of spindle No. 5

When the knee brake action was applied to spindle No. 6, the rotation speed of spindle No. 5 was reduced by 1.48%, and in other cases, the rotation speed of spindle No. 5 was reduced within a range of between 0.90% and 0.34%.

Measuring the rotation speed of spindle No. 6

When the knee brake action was applied to spindle No. 2, the rotation speed of spindle No. 6 was reduced by 1.09%, and in other cases, the rotation speed of spindle No. 6 was reduced within a range of between 0.96% and 0.51%.

Measuring the rotation speed of spindle No. 7

When the knee brake action was applied to spindles No. 5, No. 6 and No. 8, the rotation speed of spindle No. 7 was reduced by 1.05%, 1.41% and 1.26% respectively, and in other cases, the rotation speed of spindle No. 7 was reduced within a range of between 0.79% and 0.34%.

Measuring the rotation speed of spindle No. 8

When the knee brake action was applied to spindle No. 6, the rotation speed of spindle No. 8 was reduced by 1.11%, and in other cases, the rotation speed of spindle No. 8 was reduced within a range of between 0.99% and 0.41%.

According to the results of the above-mentioned experiment, it was found that, in each test of measuring the rotation speed of the particular spindles, in one to three cases a reduction of the rotation speed of the particular spindle exceeds 1%. Even though the duration of the above-mentioned reduction of the rotation speed of the particular spindle is very short, compared with the time required to produce a full packaged cop, nevertheless when driving spindles at a drive speed of more than 20.000 rpm., since the length of yarn produced in a period of a reduction of the rotation speed of the particular spindle, wherein the rotation speed thereof is reduced, is fairly long. Therefore, it is impossible to neglect the variations of the number of twists imparted to a spinning yarn produced by the particular spindle, when the knee brake action is applied to another spindle belong to an identical driving system.

According to the results of the above-mentioned experimental test, it was found that it is impossible to prevent the variation of rotation speed of more than 1% in one to three spindles of the unit driving mechanism applied to drive eight spindles, despite utilizing tension pulleys to prevent such variation of the rotation speed. The time consumed for applying so-called knee break action to any spindle of the unit driving mechanism is very short compared with the time consumed to produce a full size yarn package, however, in the case of utilizing a so-called high speed ring spinning frame wherein the spindles are driven at such high speed of more than 20,000 rpm, the length of yarn produced in a unit time does not become small enough so as to be able to neglect the yarn defects due to the above-mentioned variation of rotation speed of the spindle. The creation of such yarn defects should be prevented to maintain the quality of produced yarn.

Therefore, it is an object of the present invention to provide an improved unit driving mechanism by which the above-mentioned problems can be eliminated. To solve the above-mentioned problem created by the knee braking action to a spindle of the unit driving mechanism, repeated experimental test were carried out to find the desirable number of the spindles, driving wheels, tension pulleys and their arrangements in the unit driving mechanism.

As the result of these experimental tests, it was found that the following unit driving mechanism achieves the purpose of the present invention. That is, in a spinning frame provided with plural unit groups of spindles, formed by a pair of small identical number of spindles aligned at both side of the spinning frame in facing condition, arranged along the lengthwise direction of the spinning frame, the unit driving mechanism for driving spindles of each unit group of spindles is provided with at least one driving wheel and one tension pulley arranged at an inside position close to the spindle alignment at both sides of the spinning frame and an endless spindle tape mounted on the spindles of the unit group of spindles concerned, the above-mentioned driving wheels, and tension pulleys under pressing condition. The above-mentioned unit driving mechanism is driven by a driving motor provided with a motor shaft to which one of the driving wheels is coaxially and rigidly mounted, and the other driving wheels are driven by the corresponding belt driving mechanism in relation to the above-mentioned driving wheel mounted on the driving motor. To maintain the function of the unit driving mechanism, the number of spindles driven by the unit driving mechanism is restricted to six.

It was confirmed that if the above-mentioned construction of the unit driving mechanism is applied, the variation of the rotation speed of spindles can be maintained with a condition less below 1%.

Several driving mechanisms according to the present invention were designed, as the embodiments shown in FIGS. 1 to 4.

The construction and function of the unit driving mechanism for driving the above-mentioned unit group of spindles are hereinafter explained in detail with reference to the attached drawings.

Figure 1:
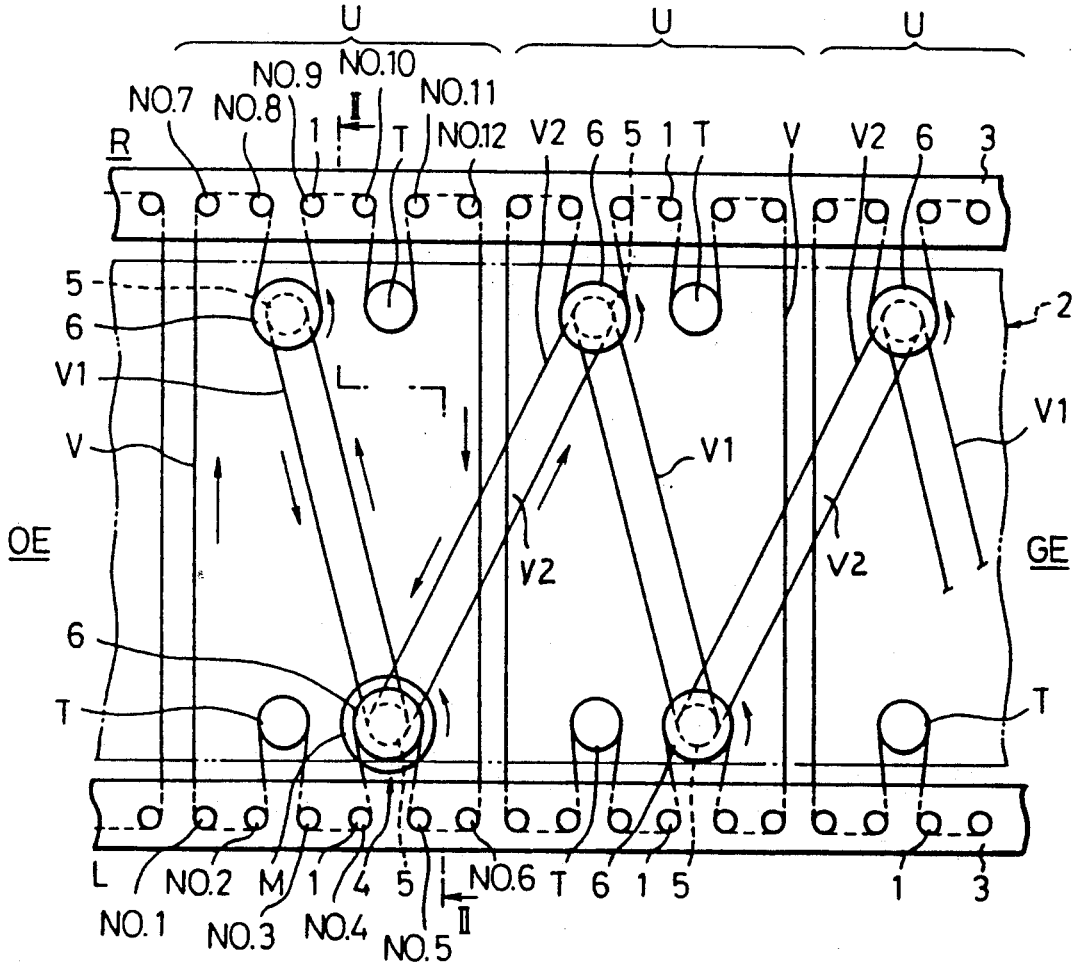
FIG. 1 is an explanatory view of an embodiment of the mechanism for driving spindles of a ring spinning frame according to the present invention.

In the first embodiment of the present invention shown in FIG. 1, a plurality of spindles 1 are arranged in alignment on the respective spindle rails 3, which are arranged at the R and L sides of a ring spinning frame 2, with a predetermined spacing between two adjacent spindles 1.

The unit driving mechanism for driving each of the unit group of spindles, according to the present invention, is constructed as follows:

The spindles 1 arranged in an alignment on the R side and L side ring rails 3 are divided into a plurality of sub units, and each sub unit consists of 6 spindles, i.e., each unit group of spindles consists of 12 spindles. The above-mentioned unit group of spindles is driven by a driving motor M by way of an endless spindle tape V and driving wheels 6, hereinafter explained in detail.

Figure 2:
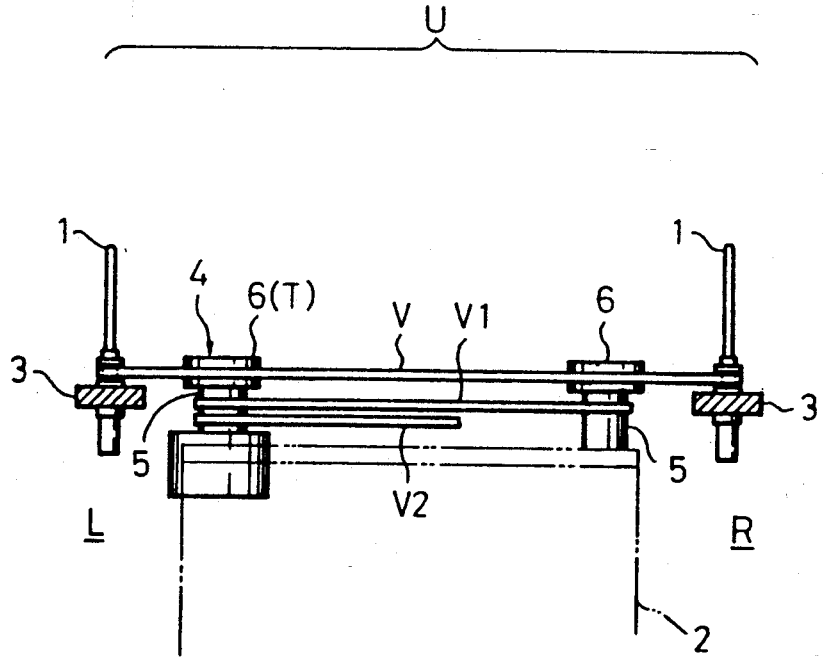
FIG. 2 is a sectional view of the driving mechanism shown in FIG. 1, taken along the line II—II in FIG. 1.

As shown in FIGS. 1 and 2, each four units of group of spindles U1, U2, U3 and U4 (not shown), which are arranged successively on the machine frame from the outer-end frame OE to the gear-end frame GE, are driven by the single driving motor M in each unit driving mechanism. Namely, in the first unit group of spindles U1, wherein twelve spindles 1 are identified by the respective number No. 1, No. 2 . . . No. 12, as shown in the drawing, the driving wheel 6 is disposed between the fourth spindle 2 and the fifth spindle 5, arranged at the L side of the ring spinning frame, and at the R side, another driving wheel 6 is disposed between the eighth spindle 8 and the ninth spindle 9. In the second unit group of spindles U2, the third unit group of spindles U3, and the fourth unit group of spindles U4 (not shown), two driving wheels 6 are respectively arranged at the L and R sides, in the same manner as the arrangement for the first unit group of spindles U1. The driving wheel 6 is rigidly and coaxially mounted on the shaft of the driving motor M arranged at the L side of the spinning frame, and driving pulleys wheels 5 are rigidly mounted coaxially on each shaft of the driving wheels 6 of the unit groups of spindles U1, U2, U3 and U4 (not shown). As shown in FIG. 1, the driving pulley 5 of the driving wheel 6 at the R side of the unit group of spindles U1 is driven by the driving pulley 5 of the driving wheel 6, on which the driving motor M is mounted, by an endless belt V1, and the driving pulley 5 arranged at the R side of the unit U2 is also driven by the driving pulley 5 of the driving wheel 6 of the L side of the unit U1, by an endless belt V2. The driving pulley 5 at the L side of the unit U2 is driven by the driving pulley 5 at the R side of the unit U2 by the endless belt V1; the driving pulley 5 at the R side of the unit U3 is driven by the driving pulley 5 at the L side of the unit U2, by the endless belt V2; the driving pulley 5 (not shown) at the L side of the unit 3 (not shown) is driven by the driving pulley 5 at the R side of the unit 3 by the endless belt V1; the driving pulley 5 (not shown) at the R side of the unit 4 (not shown) is driven by the driving pulley 5 (not shown) at the L side of the unit 3, by the endless belt V2 (not shown); and the driving pulley 5 (not shown) at the L side of the unit 4 is driven by the drive pulley 5 (not shown) at the R side of the unit 4 (not shown), by the endless belt V1 (not shown). In the above-mentioned transmission of driving power, the driving ratio between two driving pulleys 5 is maintained at 1:1. Further, in each unit driving mechanism of the unit group of spindles U1, U2, U3 and U4 (not shown), a single endless spindle tape V is utilized to drive the spindles No. 1 to No. 12, by friction contact therebetween, and two tension pulleys T are arranged as shown in FIG. 1, i.e., a tension pulley T is arranged between the spindles No. 10 and No. 11 at the R side, and a tension pulley T is arranged between the spindles No. 2 and No. 3, at the L side.

As shown in FIG. 1, the position of the tension pulley T at the L side is two spindles distant from the driving wheel 6 in the running direction of the spindle tape V, and the position of the tension pulley T at the R side is two spindles distant from the driving wheel 6 in the running direction of the spindle tape V.

To maintain a uniform friction contact between each spindle 1 and the endless spindle tape V in each unit for driving twelve spindle No. 1, No. 2, . . . No. 12, the endless spindle tape V is mounted in the following manner. Namely, after the spindle tape V is led around 12 spindles 1 of each one unit driving mechanism, a portion of the spindle tape V at the L side, i.e., a portion between the spindle No. 4 and No. 5, and a portion of the spindle tape V at the R side, i.e., a portion between the spindle No. 8 and No. 9, are pulled inside of the spinning frame and fitted onto the respective driving wheels 6, and a portion of the spindle tape V between the spindle No. 10 and No. 11 and a portion of the spindle tape V between the spindle No. 2 and No. 3 are respectively fitted around the corresponding tension pulleys T in the same way as for the driving wheels 6. According to the above-mentioned arrangement of the spindle tape T in each unit driving mechanism of the ring spinning frame, all spindles 1 of the spinning frame can be uniformly driven by driving the driving motors M of each unit driving mechanism U.

As clear from the above explanation, in the first embodiment, twelve spindles are driven by a single spindle tape V in each unit driving mechanism provided with two driving wheels 6, and the driving wheels 6 are arranged to correspond to six spindles 1, respectively.

To confirm the function of the above-mentioned driving mechanism according to the present invention, an experimental test similar to the experimental test applied to the conventional driving system shown in FIG. 5 was applied. Namely, for all spindle from No. 1 to No. 12, the reduction of the rotation speed thereof when the knee brake action is applied to another spindle of the identical unit driving mechanism was measured, and the following results were obtained.

Measuring the rotation speed of spindle No. 1

It was confirmed that the reduction of the rotation speed of spindle No. 1 was between 0.97% and 0.11%.

Measuring the rotation speed of spindle No. 2

It was confirmed that the reduction of the rotation speed of spindle No. 2 was between 0.57% and 0.06%.

Measuring the rotation speed of spindle No. 3

It was confirmed that the reduction of the rotation speed of spindle No. 3 was between 0.74% and 0.16%.

Measuring the rotation speed of spindle No. 4

It was confirmed that the reduction of the rotation speed of spindle No. 4 was between 0.75% and 0.17%.

Measuring the rotation speed of spindle No. 5

It was confirmed that the reduction of the rotation speed of spindle No. 5 was between 0.79% and 0.07%.

Measuring the rotation speed of spindle No. 6

It was confirmed that the reduction of the rotation speed of spindle No. 6 was between 0.14% and 0.01%

Measuring the rotation speed of spindle No. 7

It was confirmed that the reduction of the rotation speed of spindle No. 7 was between 0.46% and 0.02%.

Measuring the rotation speed of spindle No. 8

It was confirmed that the reduction of the rotation speed of spindle No. 8 was between 0.69% and 0.08%.

Measuring the rotation speed of spindle No. 9

It was confirmed that the reduction of the rotation speed of spindle No. 9 was between 0.88% and 0.07%.

Measuring the rotation speed of spindle No. 10

It was confirmed that the reduction of the rotation speed of spindle No. 10 was between 0.94% and 0.05%.

Measuring the rotation speed of spindle No. 11

It was confirmed that the reduction of the rotation speed of spindle No. 11 was between 0.92% and 0.08%.

Measuring the rotation speed of spindle No. 12

It was confirmed that the reduction of the rotation speed of spindle No. 12 was between 0.87% and 0.08%.

As mentioned above, it was confirmed that a reduction of the rotation speed of the spindles of more than 1% when the knee brake action is applied to another spindles in the identical unit driving mechanism can be effectively prevented by applying the above-mentioned driving mechanism shown in FIG. 1. Based upon the above experimental test, an attempt was made to use a driving mechanism wherein four spindles are added to the above mentioned unit driving mechanism, so that 16 spindles are driven by a single spindle tape V, and it was tested how the reduction of the rotation speed of each spindle of the unit driving mechanism, when the knee braking action was applied to another spindles of the identical driving mechanism is varied. According to this experimental test, it was confirmed that sometimes more than 1% reduction of the rotation speed of the spindles occurred, when the braking action by the knee brake was applied to another spindles of the identical unit driving mechanism. Therefore, it was confirmed that the upper limit of the number of spindles which can be effectively driven by each driving wheel in a unit driving mechanism by a single spindle tape, should not be more than 6.

Figure 3:
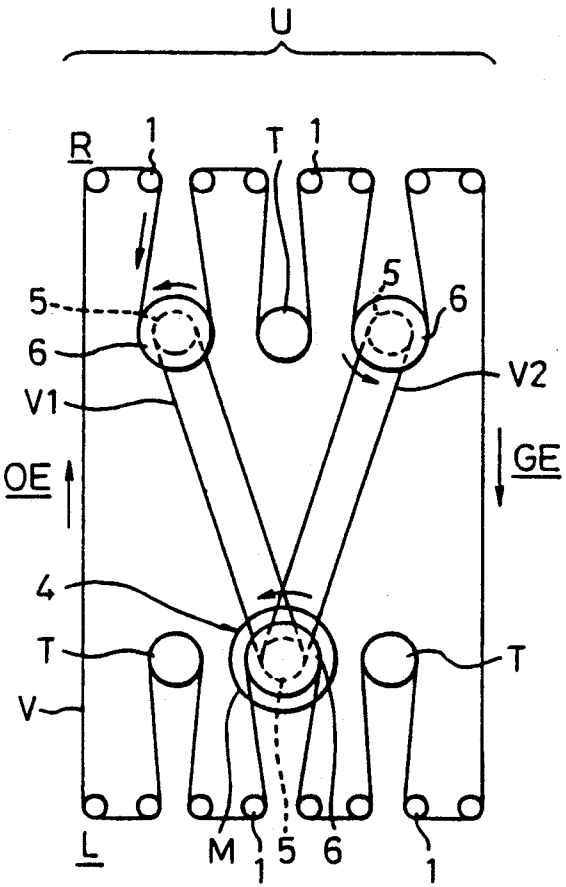
FIG. 3.

A second embodiment of the present invention is clearly shown in FIG. 3. The unit driving mechanism of the second embodiment drives 16 spindles, wherein eight spindles 1 are arranged at the R side of the spinning frame and eight spindles are arranged at the L side of the spinning frame, facing each other. In this embodiment, two driving wheels 6 are arranged at the R side of the spinning frame, and a single driving wheel 6 which is coaxially and rigidly mounted on a shaft of the driving motor M, is arranged at the L side of the spinning frame. Three driving pulleys 5 are coaxially mounted on the corresponding shafts of the driving wheels 6, and two endless belts V1 and V2 are utilized to transmit the driving power from the driving motor M to the corresponding driving pulleys 5 of the R side of the spinning frame, respectively, by way of the driving pulley 5 coaxially connected to the driving motor M. In the above-mentioned arrangement of the driving wheels 6, an endless spindle tape V drives the spindles 1, and this spindle tape V is effectively driven by the respective driving wheels 6 by a friction contact therebetween in the similar condition to the first embodiment. As shown in FIG. 3, eight spindles 1 are arranged at each side of the spinning frame in such a condition that, at the R side of the spinning frame, a tension pulley T is arranged at a position between two groups of spindles, each formed by four successively aligned spindles 1, and the driving pulley 5 is arranged at a position central between two adjacent spindles 1 of each one of the above-mentioned two groups of spindles, on the other hand, at the L side of the spinning frame, the driving wheel 5, which is coaxially and rigidly mounted on the motor shaft of the motor M, is arranged at a position between two group of spindles, each formed by four successively aligned spindles 1, and the tension pulley T is arranged at a position central between two adjacent spindles 1 of each one of the second-mentioned two groups of spindles 1. The driving wheels 6 of the R side of the spinning frame are driven by the driving motor M by way of the driving pulley 5 coaxially and rigidly mounted on the motor shaft of the motor M, the respective endless belts V1 and V2, and the respective driving pulley 5 coaxially and rigidly mounted on the shaft of the corresponding driving wheel 6. The effects of the above-mentioned arrangements of the driving wheels 6 and the tension pulleys T were confirmed as satisfying the object of the present invention.

Figure 4:
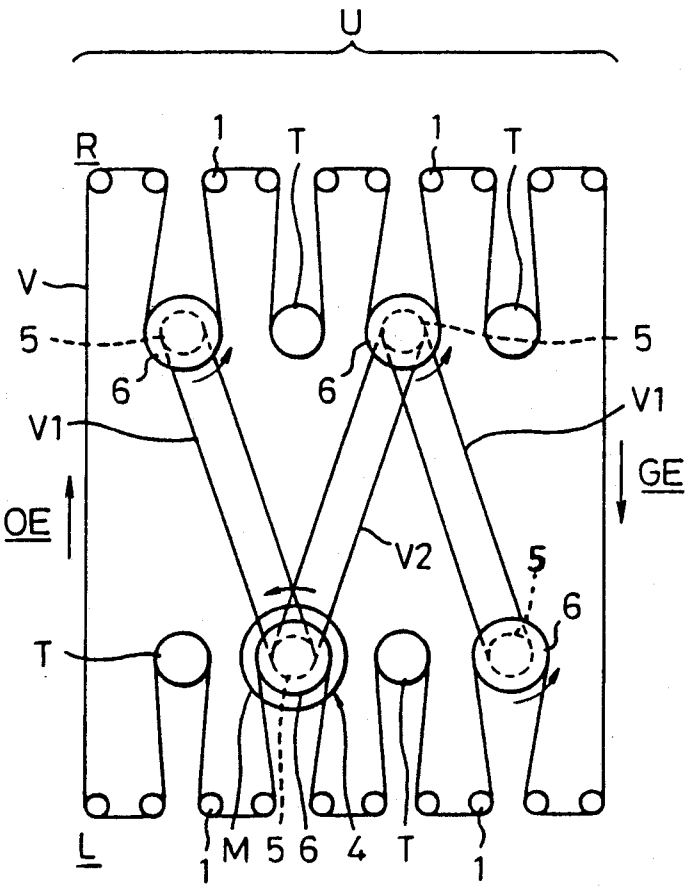
FIG. 4 are the explanatory views of other embodiments of the present invention, which are modifications of the embodiment shown in FIG. 1; and, FIG. 5 is an explanatory view showing the construction of the group driving mechanism disclosed in Unexamined Patent Publication No. Showa 63(1988)-243336.

A third modification of the present invention is shown in FIG. 4, wherein 20 spindles 1 are driven in the unit driving mechanism. As shown in FIG. 4, this unit driving mechanism is applied to drive two alignments of ten spindles 1 arranged at the R and L sides of the spinning frame in a condition facing each other.

In this embodiment, each spindle alignment on each side of the spinning frame is divided into four sub-groups of spindles 1, each sub-group of spindles 1 formed by two adjacent spindles 1. At the R side of the spinning frame, the driving wheels 6 and the tension pulleys T are arranged in an alignment at positions between the corresponding positions between two adjacent sub-groups of spindles 1, the driving wheel 6, and the tension pullyes T in the direction from the L side to R side in FIG. 4. On the other hand, at the L side of the spinning frame, the driving wheels 6 and the tension pulleys T are arranged like the arrangement thereof at the R side of the spinning frame, except the arrangement order of the driving wheels 6 and the tension pulleys T is reverse to that of R side of the spinning frame. Each driving wheel 6 is coaxially and rigidly mounted on a common shaft of the corresponding driving pulley 5, and the driving wheel 6 arranged at the L side of the spinning frame is provided with a common shaft with the driving motor M. The driving wheels 6 of the R side of the spinning frame are driven by the driving wheel 6 of the driving motor M by way of the respective endless belts V1 and V2, while the other driving pulley 5 of the L side of the spinning frame is driven by the driving pulley 5 of the R side, which is driven by the endless belt V2, by way of the endless belt V1. In this embodiment, 20 spindles are driven by the endless spindle tape V by way of the driving wheels 6 and the tension pulleys T. In for the second embodiment of the present invention, it was confirmed that the drive mechanism of this third embodiment of the present invention satisfies the object of the present invention.

By utilizing the above-mentioned drive system, it was confirmed that the consumption of electric power can be effectively lowered. Further, a remarkable feature of the present invention is that the problem of variations of the yarn twists of the spinning yarns at a time when a knee braking action is applied to other spindles of an identical group of spindles, due to the fact arising from the variation of rotation speed of spindle concerned can be effectively eliminated. Accordingly, the improved driving mechanism according to the present invention is essential to the spinning industry when the spinning frame is driven at much higher speed than a conventional spinning frame, or to a so-called long spinning frames is utilized.

We claim:

1. In a driving mechanism of spindles applied to a ring spinning frame, wherein spindle alignments arranged at right hand and left hand sides of said spinning frame are divided into a plurality of unit groups of spindles, each unit group of spindles being formed by a sub-group of spindles on said right hand side of said spinning frame and said sub-group of spindles of said left hand side facing each other, a plurality of driving mechanisms for driving spindles of said unit group of spindles being provided aligned along a lengthwise direction of said spinning frame, each said unit driving mechanism being provided with an endless tape to drive spindles thereof, said right hand and left hand sides defining an open space therebetween, wherein the improvement of each side driving mechanism comprises;

a driving motor having a motor shaft, at least two driving wheels for driving said endless spindle tape, one of said driving wheels being coaxially mounted on said shaft of said driving motor, a driving pulley coaxially mounted on each of said driving wheels, a plurality of tension pulleys for controlling tension of said endless tape, at least one endless belt extending across said open space and mounted on each of said driving pulleys and drivingly connected to a corresponding one of said driving pulleys disposed at an opposing side of said spinning frame, said driving wheels and said tension pulleys being alternately disposed at respective positions within said open space and close to a corresponding one of said sub-group of spindles at both sides of said spinning frame in said lengthwise direction such that each of said driving wheels disposed at one said side of said spinning frame faces a corresponding one of said tension pulleys disposed at an opposing side of said spinning frame positioned between an intervening space defined by two spindles, and the number of said driving wheels is defined by the condition that the number of spindles driven by each of said driving wheels is no more than six in each said sub-group and one said drive wheel having one said pulley disposed thereon at one said side of said spinning frame includes one said endless tape mounted thereon that is in driving communication with a drive wheel and pulley disposed at an opposing side of said spinning frame.

2. An improved unit driving mechanism applied to a ring spinning frame according to claim 1, wherein the number of said spindles of said unit group of spindles is sixteen, the number of said driving wheels is three, two of said three driving wheels being disposed in alignment at one said side of said spinning frame, while the remaining one of said three driving wheels is disposed at the other said side of said spinning frame, one of said driving wheels being coaxially and rigidly mounted on said shaft of said driving motor, one of said endless belts being mounted on said driving pulley of said motor shaft.

3. An improved unit driving mechanism applied to a ring spinning frame according to claim 1, wherein the number of said spindles of said unit group is twenty, the number of said driving wheels is four, two of which are disposed at one said side of said spinning frame, while the other two driving wheels of said four driving wheels are disposed at the other said side of said spinning frame, the number of endless belts is three, one of said driving wheels disposed at one said side of said spinning frame being coaxially and rigidly mounted on said motor shaft of said driving motor, said driving pulley of said driving wheel mounted on said motor shaft being connected to said two driving pulleys disposed at said opposing side of said spinning frame by way of a first and second one of said endless belts separately, said driving pulley of said other driving wheel disposed at an identical side of said spinning frame as said motor and said driving pulley disposed at said other side of said spinning frame, to face said tension pulley at an intermediate position between said driving pulley mounted on said driving motor and said driving pulley disposed at said identical side of said spinning frame as said motor is connected by a third one of said three endless belts being mounted thereon.

4. An improved unit driving mechanism applied to a ring spinning frame according to claim 1, wherein at least one said unit group of spindles comprise four said sub-groups of spindles on said right hand side and said left hand side of said spinning frame.

* * * * *